US007094744B1

(12) United States Patent
Kobayashi et al.

(10) Patent No.: US 7,094,744 B1
(45) Date of Patent: Aug. 22, 2006

(54) METHOD FOR PRODUCING SHEETLIKE DETERGENT

(75) Inventors: Hideo Kobayashi, Tochigi (JP); Masaki Sakamoto, Tochigi (JP); Masahide Okumura, Tochigi (JP); Hironobu Kawajiri, Tochigi (JP); Keiichi Onoda, Tochigi (JP); Masayasu Sato, Tochigi (JP); Katsuhiko Kasai, Wakayama (JP)

(73) Assignee: Kao Corporation, Tokyo (JP)

( * ) Notice: Subject to any disclaimer, the term of this patent is extended or adjusted under 35 U.S.C. 154(b) by 133 days.

(21) Appl. No.: 10/111,799

(22) PCT Filed: Oct. 25, 2000

(86) PCT No.: PCT/JP00/07467
§ 371 (c)(1),
(2), (4) Date: Jun. 6, 2002

(87) PCT Pub. No.: WO01/32822

PCT Pub. Date: May 10, 2001

(30) Foreign Application Priority Data

Oct. 29, 1999 (JP) ..... 11-309905

(51) Int. Cl.
*C11D 11/00* (2006.01)
*C11D 17/04* (2006.01)
*B05D 1/00* (2006.01)

(52) U.S. Cl. ..... 510/296; 510/439; 53/450

(58) Field of Classification Search ..... 510/296, 510/439; 53/450
See application file for complete search history.

(56) References Cited

U.S. PATENT DOCUMENTS 4,610,799 A * 9/1986 Wilsberg et al. ..... 510/296
4,938,888 A * 7/1990 Kiefer et al. ..... 510/295
5,196,139 A * 3/1993 Moschner ..... 252/186.25
6,465,407 B1 * 10/2002 Hayashi et al. ..... 510/295
6,591,584 B1 * 7/2003 Saito ..... 53/450
6,699,826 B1 * 3/2004 Saijo et al. ..... 510/296

FOREIGN PATENT DOCUMENTS

| | | | |
|---|---|---|---|
| EP | 0 883 022 A1 | | 12/1998 |
| EP | 0 957 158 A1 | | 11/1999 |
| EP | 1 186 650 A1 | | 3/2002 |
| JP | 51-44524 | | 11/1976 |
| JP | 53-91913 | | 8/1978 |
| JP | 5-189744 | | 7/1993 |
| JP | 7-209512 | | 8/1995 |
| JP | 9-279200 A | | 10/1997 |
| JP | 10-72599 | | 3/1998 |
| JP | 10072593 A | * | 3/1998 |
| JP | 10072599 | | 3/1998 |
| JP | 10072600 A | * | 3/1998 |
| JP | 10-204499 | | 8/1998 |
| JP | 10-204499 A | | 8/1998 |
| JP | 10-340727 A | | 12/1998 |
| JP | 11-21594 A | | 1/1999 |
| JP | 11124600 A | * | 5/1999 |
| JP | 11-228996 A | | 8/1999 |
| JP | 2000-26899 A | | 1/2000 |
| WO | WO98/32835 | | 7/1998 |
| WO | WO00/77156 A1 | | 12/2000 |

* cited by examiner

*Primary Examiner*—Lorna M. Douyon
(74) *Attorney, Agent, or Firm*—Birch, Stewart, Kolasch & Birch, LLP

(57) ABSTRACT

A method of producing a sheet type laundry detergent which comprises continuously or discontinuously applying a doughy detergent composition that has been prepared so as to have a viscosity of 1,000 mPa·s to 50,000 mPa·s at a shear rate of 10 $s^{-1}$ to 1,000 $s^{-1}$ onto a flexible support of continuous length that is running continuously in a prescribed direction under a shear rate condition of 10 $s^{-1}$ to 1,000 $s^{-1}$ by an application to form a thin layer of the doughy detergent composition.

24 Claims, 1 Drawing Sheet

[Fig. 1]
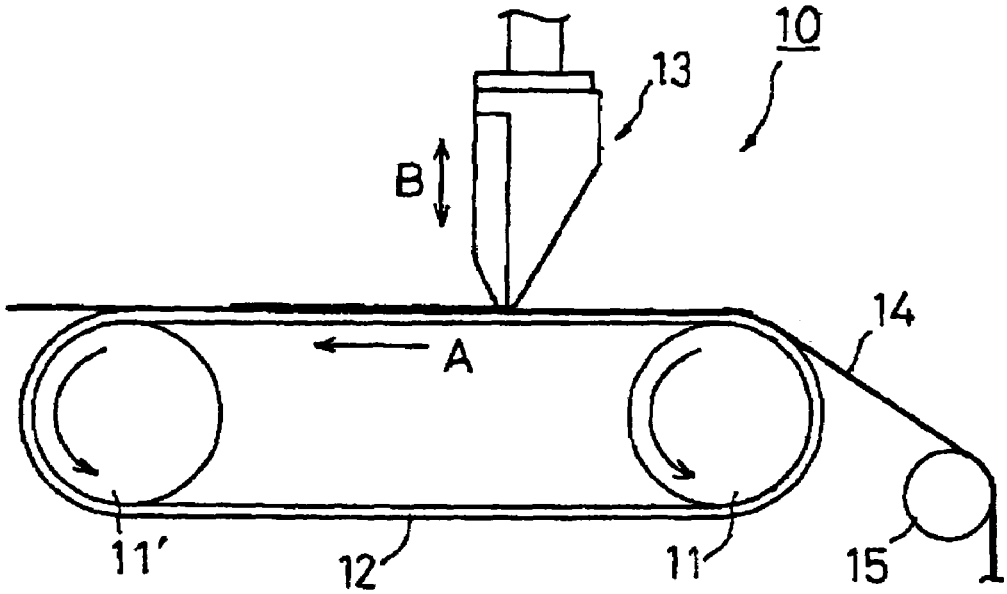

METHOD FOR PRODUCING SHEETLIKE DETERGENT

This application is the national phase under 35 U.S.C. § 371 of PCT International Application No. PCT/JP00/07467 which has an International filing date of Oct. 25, 2000, which designated the United States of America.

TECHNICAL FIELD

The present invention relates to a method for producing a sheet type laundry detergent having a thin layer of a doughy detergent composition formed on a flexible support.

BACKGROUND ART

Applicant proposed previously in JP-A-10-204499 a sheet type laundry detergent involving no scatter nor leakage of a detergent composition, which has a thin layer of a doughy detergent composition whose penetration hardness is in a specific range and a water-soluble support of sheet form disposed on both sides of the thin layer.

Unlike powdered detergent, the sheet type laundry detergent is advantageous in that detergent does not scatter when put into a washing machine and is easy to handle.

Since the doughy detergent composition is not always highly flowable, it is necessary to form the doughy detergent composition into a thin film with uniform thickness and width which exhibits high solubility when used. Further, it is not easy to form the thin film without developing defects such as air bubbles.

If the field of soaps such as sheet type soaps, a production method using a blade coater was proposed in JP-B-51-44524. The method disclosed, however, aims to obtain uniform and flexible sheet type soap by heat-melting a coating layer followed by cooling for solidification and differs from the present invention in technical means and object.

JP-A-53-91913 proposes a method of obtaining a sheet type laundry detergent in which a slurry is applied and, after drying, stripped off. Without specifying conditions for carrying out the application and the like, the method is practically difficult to carry out applying the doughy detergent composition dealt with in the present invention.

A doughy detergent composition is a viscous mixture made of a flowable material, such as liquid surface active agents, in which a powdered composition, such as solid detergent particles, is dispersed in high concentration. It exhibits complicated flow behavior, having properties intermediate between wet powder and a slurry. It is noted that the doughy detergent composition changes its properties from fluid-like to powder-like with time after preparation. The change in properties becomes more conspicuous with an increase of powdered composition concentration in the doughy detergent composition. In forming a thin layer out of a doughy detergent composition with such properties, it is preferred that the doughy detergent composition has high flowability, and for that purpose it is preferred for the composition to have a low concentration of solid detergent particles. On the other hand, a higher concentration of the solid detergent particles is preferred for developing sufficient detergent performance. Thus the flowability and the detergency of a doughy detergent composition are conflicting each other.

To use an application means in forming a thin layer of a doughy detergent composition is described in JP-A-10-72599, col. 9, ll. 14–17 and JP-A-10-204499, col. 14, ll. 10–13, but the publications do not mention conditions and the like for carrying out the application on an industrial scale, for example, for mass production; for such matter does not directly concern the inventions of the publications.

Apart from this, JP-A-5-189744 specifies the viscosity of a thixotropic fluid by setting the hysteresis loop area of a torque curve obtained with a viscometer at or below a specific value. The purpose of specifying is to control the surface roughness of an applied magnetic layer. The technique is different from the present invention of which the object is to increase the flowability of a doughy composition having a high concentration solid detergent powder to ensure satisfactory coating properties while retaining high detergency and solubility.

JP-A-7-209512 discloses an adhesive paste for a color filter which has a yield value of 0.1 Pa or higher and a non-Newtonian viscosity index of 0.9 or smaller. In this invention attention is paid to the intercept of a viscosity-shear rate curve, with no reference to the properties intermediate between fluid-like and powder-like as represented by the overall slope of the viscosity-shear rate curve.

DISCLOSURE OF THE INVENTION

Accordingly, an object of the present invention is to provide a method for producing a sheet type laundry detergent in which a thin layer of a doughy detergent composition can be formed with uniform thickness and width while retaining high solubility and detergency on use.

Another object of the present invention is to provide a method for producing a sheet type laundry detergent in which a thin film of a doughy detergent composition can be formed into a thin layer without developing defects such as air bubbles.

The present invention accomplishes the above objects by providing a method of producing a sheet type laundry detergent which comprises continuously or discontinuously applying a doughy detergent composition that has been prepared so as to have a viscosity of 1,000 mPa·s to 50,000 mPa·s at a shear rate of 10 $s^{-1}$ to 1,000 $s^{-1}$ on a flexible support of continuous length that is running continuously in a prescribed direction under a shear rate condition of 10 $s^{-1}$ to 1,000 $s^{-1}$ by means of a prescribe application means to form a thin layer of the doughy detergent composition.

The present invention also accomplishes the above objects by providing a method of producing a sheet type laundry detergent which comprises continuously or discontinuously applying a doughy detergent composition that has been prepared so as to have a viscosity of 3,000 mPa·s to 300,000 Pa·s at a shear rate of 10 $s^{-1}$ and a viscosity of 60 mPa·s to 20,000 mPa·s at a shear rate of 1,000 $s^{-1}$ onto a flexible support of continuous length that is running continuously in a prescribed direction at a shear rate of 10 $s^{-1}$ to 1,000 $s^{-1}$ with a prescribed application means.

The present invention also accomplishes the above objects by providing a method of producing a sheet type laundry detergent which comprises forming a doughy detergent composition comprising at least one each of surface active agents, alkalis, and sequestering agents into a thin layer while the doughy detergent composition has a thixotropic flow index TR of 60 or smaller, the thixotropic flow index TR being represented by formula (1):

$$TR=(\Delta\eta(1)+\Delta\eta(10))\times 100 \quad (1)$$

wherein $\Delta\eta(1)=\eta(1)_{UP}-\eta(1)_{DOWN}$ $\Delta\eta(10)=\eta(10)_{UP}-\eta(10)_{DOWN}$ wherein $\eta(1)$ is a viscosity measured at at shear rate of 1 $s^{-1}$;

$\eta(10)$ is a viscosity measured at at shear rate of 10 $s^{-1}$;

subscript UP indicates "measured during loading"; and subscript DOWN indicates "measured during unloading."

The present invention also accomplishes the above objects by providing a method of producing a sheet type laundry detergent which comprises forming a doughy detergent composition comprising at least one each of surface active agents, alkalis, and sequestering agents into a thin layer while the doughy detergent composition has a plastic flow index BF of 6 or smaller, the plastic flow index BF being represented by formula (2):

$$BF = \sqrt{\left(\frac{D\eta_2 - D\eta_1}{D\eta_1}\right)^2} \times 100 \text{ wherein} \quad (2)$$

$$D\eta_1 = \log\frac{\eta(10)}{\eta(1)}$$

$$D\eta_2 = \log\frac{\eta(100)}{\eta(10)}$$

wherein $\eta(1)$ is a viscosity measured at a shear rate of 1 $s^{-1}$;

$\eta(10)$ is a viscosity measured at a shear rate of 10 $s^{-1}$; and $\eta(100)$ is a viscosity measured at a shear rate of 100 $s^{-1}$.

BRIEF DESCRIPTION OF THE DRAWING

FIG. 1 schematically illustrates the main part of an apparatus preferably used in the method of producing the sheet type laundry detergent according to the present invention.

BEST MODE FOR CARRYING OUT THE INVENTION

The present invention will be described based on its preferred embodiments with reference to the accompanying drawing. FIG. 1 shows the main part of a production apparatus 10 which is preferably used in the method of producing the sheet type laundry detergent according to the present invention. The apparatus 10 has an endless belt 12 turning as supported by a pair of rolls 11 and 11' revolving in the same direction. The endless belt 12 runs in the direction indicated by arrow A in the FIGURE.

An extrusion type die coater 13 is disposed on the outer side of the endless belt 12 with its head facing the endless belt 12. The extrusion type die coater 12 is preferred to other types of coaters for its capability of applying a doughy detergent composition having a broader range of viscosity and forming a more uniform coating film. Having a closed system from dough feed to application, it suppresses the doughy detergent composition's changing its physical properties and involves little loss of the doughy detergent composition as compared with other types of coaters. It also has higher coating ability than other coaters. The die coater 13 has a front edge surface (not shown) and a rear edge surface (not shown) to form a narrow slit (not shown) therebetween across the running direction of the endless belt 12. The die coater 13 is maintained at a constant temperature by an electric heater.

The front edge surface and the rear edge surface may be flat or curved with a prescribed curvature according to the rheological characteristics of the doughy detergent composition. While varying depending on the rheological characteristics of the doughy detergent composition, the thickness of the thin layer to be formed, and the like, the width of the slit is preferably 0.5 mm to 30 mm in order to assure both a stabilized flow of the doughy detergent composition when applied thereby to form a uniform coating film and ease of deliver against the coating pressure.

A flexible support 14 of continuous length unwound from a stock roll (not shown) is guided by a guide roll 15 and runs continuously on the endless belt 12 in the same direction of the endless belt 12. The flexible support 14 runs continuously in parallel with the front and the rear edges of the die coater 13.

The die coater 13 is connected to a doughy detergent composition feed source (not shown). The doughy detergent composition is pressed toward and extruded from the slit formed at the tip of the die coater 13 by a feed means, such as a constant delivery pump, and applied onto the continuously running flexible support 14 through the slit.

The die coater 13 is movable in the direction perpendicular to the running plane of the flexible support 14 (the direction indicated by arrow B in FIG. 1), bringing the tip of the die coater 13 close to or apart from the flexible support 14.

The doughy detergent composition is applied to the flexible support 14 by means of the die coater 13 to form a thin layer 17 of the doughy detergent composition on the flexible support 14. As far as the die coater 13 is always close the flexible support 14, the thin layer 17 is formed continuously on the flexible support 14. Where the die coater is occasionally separated from the flexible support 14, the thin layer 17 is formed discontinuously on the flexible support 14.

The thin layer 17 may cover the whole width of the flexible support 14 but is preferably formed to leave a non-coated margin of prescribed width on both sides of the flexible support 14. One or more rows of prescribed width may be left uncoated in the flexible support running direction to form the thin layer 17 in two or more rows.

The flexible support 14 may be supported directly by the pair of rolls 11 and 11' or by a single roll placed right under the die coater 13. It is preferably supported by the endless belt 12 which is supported by the rolls 11 and 11' as in the present embodiment.

The doughy detergent composition to be applied to the flexible support 14 includes one suitable specially for cleaning clothing. It is preferred for the doughy detergent composition to have flowability enough to be fed onto the surface of the flexible support 14 and to have shape retention after being applied onto the flexible support 14 in thin film form. The term "doughy composition" as used herein denotes a kneaded mixture of a powdered composition and a flowable substance, such as liquid, paste or gel, as described in JP-A-10-204499 filed by the present applicant. The flowable substance includes a substance capable of fluidization under heat, pressure or shear.

The doughy detergent composition, being a kneaded mixture of a powdered composition and a flowable substance such as a liquid surface active agent, exhibits complicated flow behavior with properties intermediate between wet powder and a slurry.

Accordingly, the rheological characteristics of the doughy detergent composition cannot be regarded, equal to those of ordinary fluids. The present inventors have studied extensively on means for forming a uniform thin layer by applying the doughy detergent composition having such peculiar rheological characteristics. They have found as a result that the shear rate and viscosity of the doughy detergent composition to be applied are greatly influential. As a result of further investigation, they have found that adjusting the viscosity of the doughy detergent composition at a shear rate of 10 $s^{-1}$ to 1,000 mPa·s to 50,000 mPa·s facilitates the next step of forming a uniform thin layer. Adjusting the viscosity of the doughy detergent composition to be applied to 1,000 mPa·s or higher assures satisfactory shape retention at both edges of the formed thin layer 17. Adjusting the viscosity to 50,000 Pa·s or lower assures stable and continuous formation of the thin layer without developing such defects as air bubbles and facilitates feed by a transport means such as a pump. It is particularly preferred to adjust the viscosity within a range of from 1,200 mPa· to 45,000 mPa·s, especially from 1,500 mPa·s to 40,000 mPa·s, from the standpoint of upstand of both edges of the thin layer 17, prevention of air bubble entrapment, and ease of feed. This method of application will hereinafter referred to as application method A.

Apart from the application method A, the present inventors have conducted various studies on a means for applying the doughy detergent composition to form a uniform thin layer and found that the shear rate and pseudoplasticity of the doughy detergent composition to be applied are greatly influential. It is preferred for the doughy detergent composition to flow easily when formed into a thin film and, on the other hand, to hardly flow after application to retain the edge shape of the thin layer 17. To satisfy these conflicting requirements simultaneously, various investigations have been made to find use of pseudoplasticity effective. That is, it is desirable that the viscosity be low at a high shear rate to assure easy flow and be high at a low shear rate to achieve hard flow. Further study revealed that a doughy detergent composition prepared to have a viscosity of 3,000 mPa·s to 300,000 mPa·s at a shear rate of 10 $s^{-1}$ and a viscosity of 60 mPa·s to 20,000 mPa·s at a shear rate of 1,000 $s^{-1}$ is easy to form into a uniform thin film in the subsequent step. This method of application will hereinafter be referred to as application method B.

In detail, where the doughy composition before the application step has a viscosity of less than 3,000 mPa·s and less than 60 mPa·s at a shear rate of 10 $s^{-1}$ and 1,000 $s^{-1}$, respectively, the applied thin layer 17 will spread to increase its width and fail to retain its edge shape, and the pressure in a coating apparatus cannot be increased sufficiently. If the viscosity at a shear rate of 10 $s^{-1}$ and 1,000 $s^{-1}$ is 3,000 mPa·s or higher and 60 mPa·s or higher, respectively, both edges of the applied thin layer 17 exhibit satisfactory shape retention, and the pressure in a coating apparatus can be increased sufficiently for uniformly distributing the dough over the width. Further, the bridging force exerted between detergent particles and the liquid components held among the detergent particles is enhanced to improve resistance against oozing of the liquid components. If the viscosity at a shear rate of 10 $s^{-1}$ and 1,000 $s^{-1}$ exceeds 300,000 mPa·s and 20,000 mPa·s, respectively, feed with the aid of a transport means such as a pump is difficult, easily resulting in development of coating defects, such as skips and air entrainment, and a failure to form a coating layer continuously and stably. With the viscosity at a shear rate of 10 $s^{-1}$ and 1,000 $s^{-1}$ being not more than 300,000 mPa·s and not more than 20,000 mPa·s, respectively, the dough can be easily fed by use of a transport means such as a pump, and a coating layer can be formed continuously and stably without developing defects such as air bubbles. In addition, the adhesive force among detergent particles can be controlled below a certain level thereby preventing consolidation and particle destruction, which will result in increased solubility of the sheet type laundry detergent.

It is particularly preferred that the viscosity at a shear rate of 10 $s^{-1}$ be 5,000 to 200,000 mPa·s, especially 6,000 to 170,000 mPa·s, and that at a shear rate of 1,000 $s^{-1}$ be 300 to 15,000 mPa·s, especially 500 to 12,000 mPa·s, from the standpoint of satisfactory upstand of both edges of the thin layer 17, prevention of air bubble entrapment, and ease of feed.

The present inventors have conducted detailed study on a means for forming a uniform thin layer by applying the doughy detergent composition according to the application method B. As a result, they have discovered that the flow curve of the doughy detergent composition follows the Casson's equation represented by formula (3) shown below and that coefficients $C_0$ and $C_1$ of the equation are greatly influential.

$$\sqrt{\tau}=C_0+C_1\sqrt{\dot{\gamma}} \quad (3)$$

wherein $\tau$ represents a shear stress and $\dot{\gamma}$ represents a shear rate.

That is, it is preferred for the doughy detergent composition to have coefficients $C_0$ and $C_1$ such that $5<C_0<50$ and $0.5<C_1<3$. This is preferred for obtaining sufficient coating properties and shape retention, providing a sheet type laundry detergent with sufficient solubility, and preventing oozing of the liquid components.

In detail, if the coefficient $C_0$ in formula (3) is equal to or smaller than 5, the applied thin layer 17 fails to retain its edge shape. If it is equal to or greater than 50, the applied thin layer 17 would be discontinuous. With the coefficient $C_0$ in formula (3) ranging $5<C_0<50$, the doughy detergent composition immediately after being applied can be endowed with plastic properties to exhibit increased shape retention after application enough to maintain the edge shape of the formed thin layer 17. Further, the bridging force exerted in the doughy detergent composition between detergent particles and the liquid components held among the detergent particles is enhanced to improve resistance against oozing of the liquid components from the sheet type laundry detergent. Furthermore, some continuity can be imparted to the doughy detergent composition in thin layer formation so that the doughy detergent composition while applied can keep flowability. As a result, development of defects, such as skips and air bubbles, in the formed thin layer 17 can be prevented. Additionally the adhesive force among detergent particles can be controlled below a certain level thereby preventing consolidation and particle destruction during film formation, which will result in increased solubility of the sheet type laundry detergent.

If $C_1$ in formula (3) is equal to or smaller than 0.5, the pressure in the die buffer cannot be increased. If it is 3 or greater, the formed thin layer 17 suffers from unevenness on its surface, which will impair the appearance of the thin layer 17. Accordingly, with the coefficient $C_1$ in formula (3) ranging $0.5<C_0<3$, the doughy detergent composition exerts a thixotropic thickening effect in a relatively low shear rate range. As a result, the pressure for distributing the composition in the buffer of the die coater 13 can be increased to form the thin layer 17 with a uniform thickness over its whole width. The doughy detergent composition also exerts a thixotropic thinning effect in a relatively high shear rate range to increase its self-leveling property after application thereby providing the thin layer 17 with a smooth upper surface.

For further ensuring the above-described effects, the coefficient $C_0$ in formula (3) is still preferably $7<C_0<40$, particularly preferably $8<C_0<35$; and the coefficient $C_1$ is still preferably $0.8<C_1<2.7$, particularly preferably $1.0<C_1<2.5$.

The coefficients $C_0$ and $C_1$ are measured as follows. A concentric cylinder fixture having an inner diameter of 25 mm, an outer diameter of 27 mm, and a total length of 32 mm is fitted on, for example, RDA-II manufactured by Rheometrics. The temperature of the test fixture is maintained at 80° C., and a doughy detergent composition is put into the test fixture. A shear stress is measured at a few shear rates while the shear rate is increased up to 100 $s^{-1}$ and decreased to obtain a flow curve of the doughy detergent composition which represents the relationship of $\tau$ vs. shear rates $\dot{\gamma}$. The curve obtained from the square root of $\tau$ and that of $\dot{\gamma}$ is first approximated by the method of least squares, and the intercept b is taken as coefficient $C_0$ and the slope a as coefficient $C_1$. The manner of shear rates $\dot{\gamma}$ loading and unloading for measuring the shear stresses $\tau$ is desirably decided by taking into consideration the stabilization time, the measuring time, and the number of measuring points which are essentially required for securing measurement reproducibility and also in such a manner as to represent the shear history actually given to the doughy detergent composition in an application apparatus from a feed source up to the application site. For example, the shear rate was successively changed in the sequence of 1 $s^{-1}$→3.2 $s^{-1}$→10 $s^{-1}$→32 $s^{-1}$→100 $s^{-1}$→32 $s^{-1}$→10 $s^{-1}$→3.2 $s^{-1}$→1 $s^{-1}$, the time required for every change being 6 seconds, and each $\dot{\gamma}$ being maintained for 10 seconds.

In either of the application methods A and B, the temperature of the doughy detergent composition is preferably controlled at 100° C. or lower when applied to the flexible support 14 by the die coater 13. Where the temperature of the doughy detergent composition applied to the flexible support 14 by the die coater 13 exceeds 100° C., change in composition due to evaporation of detergent components with time or high-temperature-induced chemical denaturation can result.

In either of the application methods A and B, the extrusion type die coater described above can be replaced with other application means, such as a doctor blade.

The present inventors have studied on a means for continuously and stably forming a uniform thin layer from the doughy detergent composition apart from the application methods A and B. As a result they have found that the viscosity hysteresis characteristics of the doughy detergent composition exert great influences. Of the above-described doughy detergent compositions those containing a powder composition, such as solid detergent particles, in a high proportion generally tend to exhibit instable flow behavior due to shear history. The instability of the doughy detergent composition's flow behavior also appear when the doughy detergent composition is left to stand from its preparation to application for a long time. The change in flow stability of the doughy detergent composition with time is assumed to be due to agglomeration of the solid particles and the oil-absorbing effect of the solid particles on the liquid components. It is indispensable for the doughy detergent composition to have stable flow characteristics in order to achieve continuous and stable thin layer formation by application. However, the step of thin layer formation by application involves so many changes in shear given to the doughy detergent composition by pumping operation, flow in piping, stagnation in a reservoir, deformation in the thin layer forming region, the staring and/or ending operation of the thin layer forming step, and the like. Thin layer formation is liable to be instabilized because of such shear history. In addition, the times required for unit operations such as mixing, delivery, and storage lead to variation of the time from preparation to application of the doughy detergent composition, which unavoidably contributes to instabilization of the thin layer formation.

Accordingly, in order to carry out thin layer formation by application continuously and stably, it is important that the doughy detergent composition hardly changes its flow behavior notwithstanding the shear history and that the doughy detergent composition be applied while in a stable state before it undergoes change with time. However, the parameters typically representing the flow behavior of solid-liquid disperse systems, such as viscosity and thixotropy index, are unfit for grasping the flow behavior stability of the doughy detergent composition. As a result of the inventors' intensive study, it has been revealed that the flow behavior stability of the doughy detergent composition can be represented by a thixotropic flow index TR of the above-described formula (1). They have reached a finding that the above object is accomplished by completing the thin layer forming step while the TR is in a given range.

The thixotropic flow index TR concerns the relationship between viscosity $\eta$ and shear rate $\tau$ of the doughy detergent composition. In detail, when shear history is given to the doughy detergent composition by increasing and then decreasing a shear rate, TR is the sum of $\Delta\eta(1)$, which is a difference between the viscosity at 1 $s^{-1}$ during loading and the viscosity at 1 $s^{-1}$ during unloading, and $\Delta\eta(10)$, which is a difference between the viscosity at 10 $s^{-1}$ during loading and the viscosity at 10 $s^{-1}$ during unloading. The smaller the sum, the smaller the difference in viscosity between loading and unloading curves. This means that the doughy detergent composition exhibits stable flow behavior irrespective of shear history. Further study has revealed that a doughy detergent composition containing solid particulate components in a high proportion can be formed into a thin layer stably while minimizing quality variation occurring in the thin layer forming step, and sufficient detergency can be manifested when the doughy detergent composition is applied while in the state that the thixotropic flow index TR represented by formula (1) is 60 or less. This method of application will hereinafter be referred to as application method C.

In detail, if a doughy detergent composition is in a state with a thixotropic flow index TR exceeding 60 when it is formed into a thin layer, the rate of delivery by a pump is instable, resulting in variation of width of the thin layer. Further, the pressure distribution in the application apparatus in the width direction becomes non-uniform, resulting in variation of thin layer thickness in the width direction. Furthermore, the formed thin layer is liable to suffer from scratches and skips. Therefore, applying a doughy detergent composition while its thixotropic flow index TR is 60 or smaller provides a thin layer with uniform dimensions in the width and thickness directions, preventing scratches and skips. Seeing that improvement on detergency of the sheet type laundry detergent needs incorporation of a high proportion of a powder composition such as solid detergent particles in the doughy detergent composition, the application method C allows a higher proportion of a powder composition to be incorporated in the preparation of the doughy detergent composition thereby providing a sheet type laundry detergent with enhanced detergency. This is because the variation of flow characteristics of the doughy detergent composition can be reduced by completing the application of the doughy detergent composition while it is in a state with weak thixotropy. These effects are particularly pronounced when the thixotropic flow index TR is 0 to 40, particularly 0 to 30.

The thixotropic flow index TR changes with time after the preparation of the doughy detergent composition. In the present invention, formation of the doughy detergent composition into a thin layer should be finished while the thixotropic flow index TR is 60 or smaller.

The thixotropic flow index TR is measured as follows. A concentric cylinder fixture having an inner diameter of 19.3 mm, an outer diameter of 23.1 mm, and a total length of 32 mm is fitted on, for example, a rotational viscometer Roto-Visco RV20 manufactured by Thermo Haake. A doughy detergent composition is put into the test fixture, and its temperature is maintained at 80° C. In the production of a sheet type laundry detergent, since the shear rate varies from 1 to 100 $s^{-1}$ from place to place in the piping, the difference in viscosity corresponding to the difference in shear rate is noted. While a shear rate is increasing up to $\dot{\gamma}$=100 $s^{-1}$ and then decreasing, the viscosity of the doughy detergent composition kept at that temperature is measured. The thixotropic flow index TR is obtained from the viscosities $\eta(1)^{UP}$ and $\eta(1)_{DOWN}$ measured at 1 $s^{-1}$ under loading and unloading, respectively, and the viscosities $\eta(10)_{UP}$ and $\eta(10)_{DOWN}$ measured at 10 $s^{-1}$ under loading and unloading, respectively.

Apart from the methods A to C the present inventors have researched a means for continuously and stably forming a uniform thin layer from the doughy detergent composition and proved, as a result, that the linearity of the flow behavior of the doughy detergent composition has great influences. As stated previously, doughy detergent compositions containing a powder composition such as solid detergent particles in a high proportion tend to manifest plastic properties and undergo instability of flowability. In particular, the broad changes in shear rate in handling the doughy detergent composition are apt to instabilize thin layer formation. Accordingly, it is significant for the doughy detergent composition to exhibit linear flow behavior in a broad shear rate range in order to achieve continuous and stable thin layer formation by application. The present inventors have found that the flow behavior stability of the doughy detergent composition can be specified in terms of the plastic flow index BF according to the above-described formula (2). They have ascertained that the object is accomplished by completing the thin layer forming step while BF is in a specific range.

The plastic flow index BF concerns the relationship between viscosity $\eta$ and shear rate $\tau$ of the doughy detergent composition. In detail, it represents the change in slope of log $\eta$(viscosity) vs. log $\tau$(shear rate) plots, obtained as a percentage change of the slope $D\eta_2$ in a shear rate $\tau$ range of 10 to 100 $s^{-1}$ to the slope $D\eta_1$ in a shear rate $\tau$ range of 1 to 10 $s^{-1}$. The smaller the change, the more linear the log $\eta$ vs. log $\tau$ plot in a shear rate $\tau$ range of 1 to 100 $s^{-1}$. This means more uniform flow behavior of the doughy detergent composition over a broad range of shear rate. As a result of further investigation, it has been ascertained that a doughy detergent composition containing solid particles in a high proportion can be formed into a thin layer stably by applying the doughy detergent composition while its plastic flow index BF is 6 or smaller. In this case, quality variation which may occur in the thin layer forming step can be minimized, and sufficient detergency is exhibited. This method of application will hereinafter be referred to as method D.

In more detail, where the doughy detergent composition while being applied has a plastic flow index BF exceeding 6, the delivery by a pump becomes instable, resulting in variations in width of the thin layer. Further, the pressure distribution in the application apparatus in the width direction becomes non-uniform, resulting in non-uniformity of thin layer thickness in the width direction. Furthermore, agglomerates tend to generate in a stagnant part in the piping, resulting in scratches and skips of the formed thin layer. Therefore, applying a doughy detergent composition while its plastic flow index BF is 6 or smaller provides a thin layer with uniform dimensions in the width and thickness directions while preventing generation of agglomerates in the piping thereby preventing scratches and skips in the thin layer formed. Seeing that achieving improved detergency of a sheet type laundry detergent requires a high proportion of a powder composition such as solid detergent particles in the doughy detergent composition, the application method D allows a higher proportion of a powder composition to be incorporated in the preparation of the doughy detergent composition thereby providing a sheet type laundry detergent with enhanced detergency. This is because the variation of flow characteristics of the doughy detergent composition can be reduced by completing the application of the doughy detergent composition while it is in a state with weak plastic properties.

These effects are particularly pronounced when the plastic flow index BF is 0 to 4.5, particularly 0 to 3.

The plastic flow index BF changes with time after the preparation of the doughy detergent composition. In the present invention, forming the doughy detergent composition into a thin layer is finished while the plastic flow index BF is 6 or smaller.

It is desirable that the doughy detergent composition be formed into a thin layer while in the state that the $D\eta_1$ value of formula (2) is 0.95 or smaller, particularly 0.9 or smaller, especially 0.85 or smaller, in view of ease in delivery by use of a transport means such as a pump and prevention of skips or bubble entrainment of the thin layer. Smaller $D\eta_1$ values bring about better results, but the possible minimum is about 0.5.

It is also desirable that the doughy detergent composition be formed into a thin layer while in the state that the $D\eta_2$ value of formula (2) is 0.95 or smaller, particularly 0.9 or smaller, especially 0.88 or smaller, in view of improved leveling properties of the doughy detergent composition after application, which will lead to improvement in surface smoothness of the thin layer. Smaller $D\eta_2$ values bring about better results, but the possible minimum is about 0.5.

The plastic flow index BF is measured as follows. A concentric cylinder fixture having an inner diameter of 19.3 mm, an outer diameter of 23.1 mm, and a total length of 32.0 mm is fitted on, for example, a rotational viscometer Roto-Visco RV20 manufactured by Thermo Haake. A doughy detergent composition is put into the test fixture, and its temperature is maintained at 80° C. In the production of a sheet type laundry detergent, since the shear rate varies from 1 to 100 $s^{-1}$ from place to place in the piping, the difference in viscosity corresponding to the difference in shear rate is noted. A viscosity curve showing the relationship of viscosity $\eta$ vs. shear rate $\dot{\gamma}$ of the doughy detergent composition is obtained under loading up to a shear rate $\dot{\gamma}$ of 100 $s^{-1}$ and then unloading. The plastic flow indices $BF_{UP}$ and $BF_{DOWN}$ in loading and unloading, respectively, are obtained from the viscosities $\eta(1)$, $\eta(10)$, and $\eta(100)$ measured at shear rates 1 $s^{-1}$, 10 $s^{-1}$, and 100 $s^{-1}$ during loading and unloading. An average of $BF_{UP}$ and $BF_{DOWN}$ is calculated to obtain the plastic flow index BF.

In forming a thin layer while the plastic flow index BF is in the above-described range, it is a preferred embodiment that the doughy detergent composition is formed into a thin layer while in the state that the thixotropic flow index TR, represented by formula (1), is 60 or smaller, particularly 30 or smaller. This embodiment is preferred for further ensuring stability in forming a thin layer of a doughy detergent composition containing solid particles in a high proportion, further suppressing quality variation which may occur in the thin layer forming step, and further improving the detergency.

In carrying out the application method C or D, the manner of shear $\dot{\gamma}$loading and unloading for measuring viscosities η is desirably decided by taking into consideration the stabilization time, the measuring time, and the number of measuring points which are essentially required for securing measurement reproducibility and also in such a manner as to represent the shear history actually given to the doughy detergent composition in an application apparatus from a feed source up to the application region. For example, the shear rate was successively changed in the sequence of 1 $s^{-1}$→3.2 $s^{-1}$→10 $s^{-1}$→32 $s^{-1}$→100 $s^{-1}$→32 s−1→10 $s^{-1}$→3.2 $s^{-1}$→1 $s^{-1}$, the time required for each change being 6 seconds, and each $\dot{\gamma}$being maintained for 10 seconds.

In carrying out the application method C or D, the doughy detergent composition is preferably prepared so as to have a viscosity of 10,000 mPa·s to 100,000 mPa·s, particularly 15,000 mPa· to 80,000 mPa·s, at a shear rate of 10 $s^{-1}$. This is preferred for obtaining satisfactory edge shape retention of the thin layer 17, ability to stably form a thin layer in a continuous manner without developing such defects as air bubbles, and ease of delivery by use of a transport means such as a pump.

In either of the application methods C and D, the temperature of the doughy detergent composition to be applied is preferably controlled at 100° C. or lower, particularly between 60 and 100° C., to prevent change in composition due to evaporation of detergent components with time or high-temperature-induced chemical denaturation. For example, in this embodiment where the doughy detergent composition is applied to the flexible support 14 by the die coater 13, the temperature of the doughy detergent composition is preferably controlled so that its temperature at the time of application is 100° C. or lower.

In either of the application methods C and D, the application means used to form the doughy detergent composition into a thin layer can be replaced with a doctor coating means or a single- or multi-stage calendering means using rolls, etc.

When the doughy detergent composition is applied onto the flexible support 14 by means of the die coater 13 according to any of the application methods A to D, it is preferred for stable formation of the thin layer 17 that the feed rate of the doughy detergent composition be controlled so that the doughy detergent composition to be applied may have a shear rate of 10 $s^{-1}$ to 1000 $s^{-1}$. The shear rate of the doughy detergent composition applied to the flexible support 14 with the die coater 13 is represented by formula (4):

$$\text{Shear rate } \dot{\gamma}=U/h \quad (4)$$

wherein U is a running speed of a substrate sheet; and h is a thickness of a thin layer of the doughy detergent composition.

Where the doughy detergent composition is applied to the flexible support 14 with the die coater 13, a shear rate of 10 $s^{-1}$ or higher is effective in stably maintaining the coating bead shape on the rear edge surface to prevent coating defects such as streaks due to bead break. A shear rate of 1000 $s^{-1}$ or lower prevents air entrainment in bead formation on the rear edge surface and coating defects such as missing coating. It is still preferred to carry out application at a shear rate of 20 $s^{-1}$ to 900 $s^{-1}$, particularly 50 $s^{-1}$ to 700 $s^{-1}$, for preventing coating streaks and missing coating.

As stated above, the shear rate in applying the doughy detergent composition on the flexible support 14 by means of the die coater 13 is decided from the running speed of the flexible support 14 and the thickness of the thin layer 14. The running speed U of the flexible support 14 is preferably 5 m/min to 100 m/min, still preferably 10 m/min to 80 m/min, for assuring application stability while suppressing development of coating streaks, missing coating, etc., solubility of the flexible support 14 on use, and productivity. The thickness of the thin layer 17 is preferably 0.5 mm to 10 mm, still preferably 1.0 mm to 5.0 mm, particularly preferably 1.5 mm to 3.5 mm, from the standpoint of performance essentially required of a sheet type laundry detergent, i.e., solubility of the flexible support 14 on use and detergency, ease of using the sheet type laundry detergent attributed to the size and shape, and economy.

Other application means which can be used for applying the doughy detergent composition include air doctor coaters, blade coaters, rod coaters, knife coaters, curtain coaters, and fountain coaters. The shear rate $\dot{\gamma}$in applying with these means is decided from the running speed V (m/min) of the flexible support and the thickness d (mm) of the thin layer according to formula (5):

$$\text{Shear rate } \dot{\gamma}=V/d \quad (5)—$$

Whichever method of A to D is followed, the thin layer 17 is formed on the flexible support 14 to give a desired sheet type laundry detergent. If desired, a second flexible support of the same or different material from the flexible support 14 can be superposed on the thin layer 17 to make a sheet type laundry detergent having the thin layer sandwiched in between two flexible supports.

The sheet type laundry detergent of continuous length having the thin layer 17 on the flexible support 14 or having the thin layer 17 sandwiched in the flexible supports can be cut across the width to produce cut-to-size sheet type laundry detergents. Where the thin layer 17 is provided discontinuously in its longitudinal direction, cutting to length is preferably done in the uncoated areas.

Where the sheet type laundry detergent is made of two flexible supports and the thin layer 17 held therebetween, with the margins on both sides of the flexible supports remaining uncoated, the flexible supports may be joined together in these margins by a prescribed means for preventing the thin layer 17 from falling off, either before or after the sheet type laundry detergent in a continuous length is cut to lengths.

The thin layer 17 of cut length preferably has a perimeter to thickness ratio, a, of larger than 10 and smaller than 600, particularly 50<a<300, in view of ease of handling on use.

In any of the application methods A to D, discontinuous application of the thin layer 17 on the flexible support 14 in the longitudinal direction thereof is achieved by bringing the die coater 13 close to and apart from the flexible support 14. In place of this manner of application, the doughy detergent composition can be applied discontinuously by shuttering the die coater 13 at intervals with the vertical position of the die coater itself fixed close the flexible support 14.

The flexible support 14 of continuous length on which the doughy detergent composition is applied includes sheets and webs having flexibility, for example, synthetic resin films and fiber sheeting such as woven and nonwoven. The flexible support 14 is preferably soluble or dispersible in water. Water-soluble flexible supports 14 include (1) water-soluble films, (2) nonwoven or woven fabric made of water-soluble polymer fiber, and (3) laminated sheets composed of a water-soluble film and nonwoven or woven fabric made of water-soluble polymer fiber, which are described in JP-A-10-204499, col. 12, ll. 16–33. These flexible supports are fabricated of water-soluble polymers. Specific examples of the water-soluble polymers are polyvinyl alcohol, polyvinylpyrrolidone, pullulan, polyacrylamide, polyethylene oxide, polyvinyl methylene ether, xanthan gum, guar gum, collagen, carboxymethyl cellulose, hydroxypropyl cellulose, hydroxyethyl cellulose; and organic polymers having a carboxyl group and/or a sulfonic acid group and salts thereof, such as polyacrylic acid and its salts, polymethacrylic acid and its salts, and polyitaconic acid and its salts. Polyvinyl alcohol or maleic acid- or itaconic acid-modified polyvinyl alcohol is particularly preferred.

The rheological characteristics of the doughy detergent composition are as has been described. The formulation of the doughy detergent composition is as follows. The doughy detergent composition comprises at least one each of surface active agents, alkalis, and sequestering agents.

The surface active agents preferably include nonionic ones and anionic ones. The nonionic ones include those described in JP-A-10-204499, col. 5, ll. 6–31. Preferred of them are polyoxyalkylene alkyl ethers having an alkylene oxide (e.g., ethylene oxide or propylene oxide) added to a straight-chain or branched primary or secondary alcohol having 10 to 18 carbon atoms and having an HLB value (calculated by Griffin's method) of 10.5 to 15.0, particularly 11.0 to 14.5. The anionic surface active agents include those described in JP-A-10-204499, col. 5, ll. 39–49. Preferred of them are alkylsulfates having 12 to 18 carbon atoms and (straight-chain alkyl)benzenesulfonates having 10 to 14 carbon atoms in the alkyl moiety thereof. The counter ions preferably include alkali metal ions, particularly a sodium ion and a potassium ion. The total content of the surface active agents in the doughy detergent composition is preferably 5 to 80% by weight, still preferably 20 to 60% by weight, in view of detergency. A combined use of the nonionic surface active agent and the anionic surface active agent is also preferred. The total amount of the nonionic and the anionic surface active agents is preferably 50 to 100% by weight, particularly 70 to 100% by weight, based on the total content of surface active agents, from the viewpoint of detergency. The weight ratio of the nonionic surface active agent to the anionic surface active agent is preferably 100/0 to 10/90, still preferably 90/10, particularly 50/50, from the viewpoint of solubility.

The alkalis include those described in JP-A-10-204499, col. 5, last line to col. 6, line 9. Preferred of them are sodium carbonate, potassium carbonate, amorphous silicates, and crystalline silicates.

The sequestering agents include those described in JP-A-10-204499, col. 8, ll. 41–47. Preferred of them are crystalline aluminosilicates (zeolite), amorphous aluminosilicates, organic chelating agents, and polycarboxylic acid polymers, with sodium polyacrylate and acrylic acid-maleic acid copolymers being still preferred.

The doughy detergent composition preferably comprises 5 to 50% by weight, particularly 10 to 30% by weight, of the surface active agent(s), 5 to 60% by weight, particularly 10 to 50% by weight, of the alkali(s), and 5 to 60% by weight, particularly 10 to 50% by weight, of the sequestering agent(s).

The mixing ratio of organic compounds to inorganic compounds in the doughy detergent composition is preferably adjusted so as to maintain flowability of the doughy detergent composition and prevent detergent substances of the doughy detergent composition from leaking through the flexible support 14. A preferred mixing ratio of organic compounds to inorganic compounds is 80/20 to 10/90, particularly 70/30 to 15/85, by weight.

EXAMPLES

The present invention will now be illustrated in greater detail with reference to Examples. Unless otherwise noted, all the percents and parts are by weight. Before going into Examples, preparation of doughy detergent compositions is described (Preparation Examples 1 to 11).

Preparation Example 1

For Use in Example 1

A slurry having a water content of 50% and containing zeolite, sodium carbonate, sodium sulfate decahydrate, sodium sulfite, sodium polyacrylate, and a fluorescent dye in a ratio shown in Table 1 was spray-dried to obtain dry particles 1 (average particle size: about 250 μm) shown below. The particulars of the components in Table 1 are as shown in Table 8.

Composition of dry particles 1

| | |
|---|---|
| Zeolite | 28 parts |
| Sodium carbonate | 5.5 parts |
| Sodium sulfate decahydrate | 5 parts |
| Sodium sulfite | 0.5 part |
| Sodium polyacrylate | 5 parts |
| Fluorescent dye | 0.4 part |
| Residual water | 42.2 parts |

Nonionic surfactant (a) (7.5 kg) and 0.15 kg of PEG were put in a 50 liter-volume batch kneader (Model 1600-65CVJA-3.7, manufactured by Satake Kagaku Kikai Kogyo K.K.) and mixed while heating at 65° C. until PEG melted to provide a uniform mixture. Then, 1.73 kg of water, 0.72 kg of a 48% NaOH aqueous solution, and 2.80 kg of an alkylbenzenesulfonic acid were slowly added thereto while continuing stirring. The stirring was further continued for 10 minutes to conduct neutralization reaction thoroughly. After completion of the reaction, 3.0 kg of AS—Na powder and 3.32 kg of dry particles 1 were added thereto, followed by kneading for about 5 minutes to provide a homogeneous mixture. Further, 0.3 kg of an enzyme and 0.15 kg of a perfume were added, followed by kneading for 2 minutes to give a doughy detergent composition shown in Example 1.

Preparation Example 2

For Use in Example 2

Nonionic surfactant (a) (10.34 kg) and 3.9 kg of soda ash dense were put in a 50 liter-volume batch kneader (Model 1600-65CVJA-3.7, manufactured by Satake Kagaku Kikai Kogyo K.K.) and mixed while heating at 65° C. Then, 1.94 kg of an alkylbenzenesulfonic acid and 0.50 kg of a 48% NaOH aqueous solution were slowly added thereto simultaneously while stirring. The stirring was further continued for 10 minutes to conduct neutralization reaction thoroughly. After completion of the reaction, 2.07 kg of AS—Na powder and 1.07 kg of dry particles 2 were added thereto, followed by kneading for about 5 minutes to make a homogeneous mixture. Further, 0.18 kg of an enzyme and 0.15 kg of a perfume were added, and the mixture was stirred for 2 minutes, followed by degassing to give a doughy detergent composition.

Preparation Example 3

For Use in Examples 3 and 4 and Comparative Example 1

Doughy detergent compositions shown in Example 3 and 4 and Comparative Example 1 were obtained in the same manner as in Preparation Example 1.

Preparation Example 4

For Use in Examples 5, 6 and 8 and Comparative Examples 5 and 7

A slurry having a water content of 50% and containing zeolite, sodium carbonate, sodium sulfate decahydrate, sodium sulfite, sodium polyacrylate, and a fluorescent dye in a ratio shown in Table 2 was spray-dried to obtain dry particles 2 (average particle size: about 250 μm) shown below. The particulars of the components in Table 2 are as shown in Table 8.

| Composition of dry particles 2 | |
|---|---|
| Zeolite | 22.2 parts |
| Sodium carbonate | 65 parts |
| sodium sulfate decahydrate | 3 parts |
| Sodium sulfite | 0.3 part |
| Sodium polyacrylate | 3 parts |
| Fluorescent dye | 0.2 part |
| Residual water | 1.1 parts |

Nonionic surfactant (a) (10.34 kg) and 3.9 kg of soda ash dense were put in a 50 liter-volume batch kneader (Model 1600-65CVJA-3.7, manufactured by Satake Kagaku Kikai Kogyo K.K.) and mixed while heating at 65° C. Then, 1.94 kg of an alkylbenzenesulfonic acid and 0.50 kg of a 48% NaOH aqueous solution were slowly added thereto simultaneously while stirring. The stirring was further continued for 10 minutes to conduct neutralization reaction thoroughly. After completion of the reaction, 2.07 kg of AS—Na powder and 1.07 kg of dry particles 1 were added thereto, followed by kneading for about 5 minutes to make a homogeneous mixture. Further, 0.18 kg of an enzyme and 0.15 kg of a perfume were added, and the mixture was stirred for 2 minutes, followed by degassing to give a doughy detergent composition.

Preparation Example 5

For Use in Example 7 and Comparative Example 8

Nonionic surfactant (b) (8.41 kg) and 0.17 kg of PEG were put in a 50 liter-volume batch kneader (Model 1600-65CVJA-3.7, manufactured by Satake Kagaku Kikai Kogyo K.K.) and mixed while heating at 65° C. until PEG melted to provide a uniform mixture. After the melting, 3.30 kg of soda ash dense was added and mixed. Then, 1.57 kg of an alkylbenzensulfonic acid and 0.41 kg of a 48% NaOH aqueous solution were slowly added thereto simultaneously while stirring. The stirring was further continued for 10 minutes to conduct neutralization reaction thoroughly. After completion of the reaction, 2.52 kg of AS—Na powder, 7.92 kg of zeolite, 2.09 kg of sodium carbonate powder, 1.07 kg of anhydrous sodium sulfate, 0.10 kg of sodium sulfite powder, 1.07 kg of AA/MA powder, 0.10 kg of a fluorescent dye, 0.26 kg of an enzyme, and 0.15 kg of a perfume were added thereto. The mixture was stirred for about 15 minutes until it became homogeneous, followed by degassing to give a doughy detergent composition.

Preparation Example 6

For Use in Example 9 and Comparative Example 14

A slurry having a water content of 50% and containing zeolite, sodium carbonate, sodium sulfate decahydrate, sodium sulfite, sodium polyacrylate, and a fluorescent dye in a ratio shown in Table 3 was spray-dried to obtain dry particles 3 (average particle size: about 250 μm) shown below. The particulars of the components in Table 3 are as shown in Table 8.

| Composition of dry particles 3 | |
|---|---|
| Zeolite | 31.1 parts |
| Sodium carbonate | 8.4 parts |
| sodium sulfate decahydrate | 4.2 parts |
| Sodium sulfite | 0.4 part |
| Sodium polyacrylate | 4.2 parts |
| Fluorescent dye | 0.3 part |
| Residual water | 0.5 parts |

Nonionic surfactant (a) (12.71 kg) and 0.92 kg of sodium laurate were put in a 50 liter-volume batch kneader (Model 1600-65CVJA-3.7, manufactured by Satake Kagaku Kikai Kogyo K.K.) and mixed while heating at 65° C. until sodium laurate melted to give a uniform mixture. Then, 0.38 kg of a 48% NaOH aqueous solution was slowly added thereto simultaneously while stirring. The stirring was further continued for 10 minutes to conduct neutralization reaction thoroughly. After completion of the reaction, 15.74 kg of the dry particles was added thereto, followed by kneading for about 5 minutes to make a homogeneous mixture. Further, 0.25 kg of an enzyme and 0.15 kg of a perfume were added, followed by stirring for 2 minutes to give a doughy detergent composition.

Preparation Example 7

For Use in Example 10 and Comparative Examples 9 to 11 and 13

Nonionic surfactant (a) (10.15 kg) and 0.30 kg of PEG were put in a 50 liter-volume batch kneader (Model 1600-65CVJA-3.7, manufactured by Satake Kagaku Kikai Kogyo K.K.) and mixed while heating at 65° C. Then, 2.30 kg of AS—Na powder and 17.24 kg of the dry particles were slowly added thereto, followed by stirring for about 5 minutes to prepare a homogeneous mixture. An enzyme (0.27 kg) and a perfume (0.15 kg) were added thereto, followed by stirring for 2 minutes to give a doughy detergent composition.

Preparation Example 8

For Use in Example II and Comparative Example 12

Nonionic surfactant (a) (8.39 kg) and 0.38 kg of sodium laurate were put in a 50 liter-volume batch kneader (Model 1600-65CVJA-3.7, manufactured by Satake Kagaku Kikai Kogyo K.K.) and mixed while heating at 65° C. until sodium laurate melted to give a uniform mixture. Then, 3.14 kg of an alkylbenzenesulfonic acid and 0.38 kg of a 48% NaOH aqueous solution were slowly added thereto simultaneously while stirring. The stirring was further continued for 10 minutes to conduct neutralization reaction thoroughly. After completion of the reaction, 16.85 kg of the dry particles was added thereto, followed by kneading for about 5 minutes to make a homogeneous mixture. Further, 0.28 kg of an enzyme and 0.15 kg of a perfume were added, followed by stirring for 2 minutes to give a doughy detergent composition.

Preparation Example 9

For Use in Example 18 and Comparative Example 17

A slurry having a water content of 50% and containing zeolite, sodium carbonate, sodium sulfate decahydrate, sodium sulfite, sodium polyacrylate, and a fluorescent dye in a ratio shown in Table 7 was spray-dried to obtain dry particles 4 (average particle size: about 250 μm) shown below. The particulars of the components in Table 7 are as shown in Table 8.

| Composition of dry particles 4 | |
|---|---|
| Zeolite | 33.7 parts |
| Sodium carbonate | 9.1 parts |
| sodium sulfate decahydrate | 4.6 parts |
| Sodium sulfite | 0.5 part |
| Sodium polyacrylate | 4.6 parts |
| Fluorescent dye | 0.4 part |
| Residual water | 1.3 parts |

Nonionic surfactant (a) (11.44 kg) and 0.82 kg of sodium laurate were put in a 50 liter-volume batch kneader (Model 1600-65CVJA-3.7, manufactured by Satake Kagaku Kikai Kogyo K.K.) and mixed while heating at 65° C. until sodium laurate melted to give a uniform mixture. Then, 0.34 kg of a 48% NaOH aqueous solution was slowly added thereto simultaneously while stirring. The stirring was further continued for 10 minutes to conduct neutralization reaction thoroughly. After completion of the reaction, 17.12 kg of the dry particles was added thereto, followed by kneading for about 5 minutes to make a homogeneous mixture. Further, 0.27 kg of an enzyme and 0.15 kg of a perfume were added, followed by stirring for 2 minutes to give a doughy detergent composition.

Preparation Example 10

For Use in Example 19 and Comparative Examples 15 and 16

Nonionic surfactant (a) (9.02 kg) and 0.27 kg of PEG were put in a 50 liter-volume batch kneader (Model 1600-65CVJA-3.7, manufactured by Satake Kagaku Kikai Kogyo K.K.) and mixed while heating at 65° C. Then, 1.80 kg of AS—Na powder and 18.61 kg of the dry particles were added thereto, followed by kneading for about 5 minutes to make a homogeneous mixture. Further, 0.29 kg of an enzyme and 0.15 kg of a perfume were added, followed by kneading for 2 minutes to give a doughy detergent composition.

Preparation Example 11

For Use in Example 20 and Comparative Example 21

Nonionic surfactant (a) (7.45 kg) and 0.34 kg of sodium laurate were put in a 50 liter-volume batch kneader (Model 1600-65CVJA-3.7, manufactured by Satake Kagaku Kikai Kogyo K.K.) and mixed while heating at 65° C. until sodium laurate melted to give a uniform mixture. Then, 2.79 kg of an alkylbenzenesulfonic acid and 0.86 kg of a 48% NaOH aqueous solution were slowly added thereto simultaneously while stirring. The stirring was further continued for 10 minutes to conduct neutralization reaction thoroughly. After completion of the reaction, 18.26 kg of the dry particles was added thereto, followed by kneading for about 5 minutes to make a homogeneous mixture. Further, 0.30 kg of an enzyme and 0.15 kg of a perfume were added, followed by kneading for 2 minutes to prepare a doughy detergent composition.

Method of measuring viscosity of doughy detergent compositions:

The viscosity of the doughy detergent compositions prepared in Preparation Examples 1 to 5 was measured according to the following method. The coefficient $C_0$ and $C_1$ (the Casson's equation) of the doughy detergent compositions prepared in Preparation Examples 4 and 5 were obtained according to the aforementioned method. The results obtained are shown in Tables 1 and 2.

A concentric cylinder fixture (Couette) having an inner diameter of 25 mm, an outer diameter of 27 mm, and a total length of 32 mm was fitted on a rheometer RDA-II manufactured by Rheometrics. The viscosity of a doughy detergent composition put into the fixture and kept at 40° C. was measured at a shear rate of 10 $s^{-1}$ and 1000 $s^{-1}$.

The viscosities of the doughy detergent compositions obtained in Preparation Examples 6 to 11 were measured according to the following method. The results are shown in Tables 3 and 7.

A concentric cylinder fixture having an inner diameter of 19.3 mm, an outer diameter of 23.1 mm, and a total length of 32.0 mm was fitted on a rotational viscometer RotoVisco RV20 manufactured by Thermo Haake. A doughy detergent composition was put into the test fixture and maintained at 80° C. The shear rate $\dot{\gamma}$ was increased stepwise in the sequence of 1 $s^{-1} \rightarrow 3.2$ $s^{-1} \rightarrow 10$ $s^{-1}$ using 6 seconds for every increase. After every increase, the reached $\dot{\gamma}$ was maintained for 5 seconds, and five more seconds were taken for viscosity measurement. The viscosity $\eta$ at every $\dot{\gamma}$ was measured for every 0.5 second to provide 10 measured values, from which an average was calculated.

Examples 1 to 4 and Comparative Examples 1 to 4

Application Method A

A laminated sheet composed of water-soluble nonwoven fabric having a basis weight of 20 g/$m^2$ which was prepared in accordance with Example 2 of JP-A-8-3848 and a water-soluble film Hicellon, available from The Nippon Synthetic Chemical Industry Co., Ltd., was used as a flexible support. Each of the doughy detergent compositions obtained in Preparation Examples was applied on the water-soluble film side by means of the apparatus shown in FIG. 1 under the shear rate and temperature conditions shown in Table 1. The laminated sheet was superposed on the applied layer with its water-soluble nonwoven fabric as an outer layer. The periphery of the laminated sheets were heat sealed with FUJI IMPULSE AUTO SEALER (FA-600-5) to obtain a sheet type laundry detergent.

Performance Evaluation

The sheet type laundry detergents obtained in Examples 1 to 4 and Comparative Example 1 were evaluated for shape retention, coating properties, and solubility according to the following methods. The results obtained are shown in Table 1.

1) Method of Evaluating Shape Retention

The state of a thin layer of the doughy detergent composition immediately after being formed by using the die coater under application conditions giving a shear rate of 200 $s^{-1}$ was observed and graded based on the following standard.

a: Deformation of edges and expansion of width were not observed.

b: Deformation of edges and expansion of width were slightly observed.

c: Deformation of edges and expansion of width were observed.

2) Method of Evaluating Coating Properties

The doughy detergent composition was applied on the flexible support by means of the die coater under various conditions giving a shear rate of 50 to 1000 $s^{-1}$, and the resulting thin layer was observed and graded based on the following standard.

a: The thickness was uniform in both longitudinal and width directions. Few defects such as air bubbles were observed.

b: The thickness varied in the longitudinal and the width directions. Such defects as small air bubbles were always observed. Such defects as large air bubbles were sometimes observed.

c: Skips of the coating film occurred in the longitudinal and the width directions. Such defects as large air bubbles were always observed.

3) Method of Evaluating Solubility

Ten grams of the sheet type laundry detergent was put in a washing machine (Ginga 3.6 (VH360S1), manufactured by Toshiba Corp.) having 30 liters of tap water at 5° C. Water was stirred in a "strong agitation mode" for 5 minutes and then drained through a 500 μm sieve fitted to the drainage hole to collect the residual detergent in water, which was observed with the naked eye to evaluate the solubility based on the following standard.

a: A residue of the detergent composition was scarcely observed.

b: A small amount of a residue of the detergent composition was observed.

c: A large amount of a residue of the detergent composition was observed.

TABLE 1

| | Example | | | | Comparative Example | | | |
|---|---|---|---|---|---|---|---|---|
| | 1 | 2 | 3 | 4 | 1 | 2 | 3 | 4 |
| Doughy Detergent Composition (wt %): | | | | | | | | |
| Nonionic surfactant (a) | 25.0 | — | — | 25.0 | 41.0 | 32.9 | 25.0 | — |
| Nonionic surfactant (b) | — | 32.0 | 30.0 | — | — | — | — | 21.6 |
| LAS-Na | 5.0 | 6.5 | 5.5 | 5.0 | — | 6.6 | 10.0 | 8.7 |
| AS-Na | 5.0 | 6.5 | 5.5 | 5.0 | 5.0 | 6.6 | 10.0 | 8.7 |
| PEG | 0.5 | 0.5 | 0.5 | 0.5 | — | 0.7 | 2.0 | 1.7 |
| Zeolite | 37.0 | 31.0 | 37.0 | 37.0 | 30.0 | 31.6 | 28.0 | 34.8 |
| Sodium carbonate | 10.0 | 8.2 | 9.0 | 10.0 | 8.6 | 8.5 | 5.5 | 9.2 |
| Sodium sulfate | 5.0 | 4.2 | 5.0 | 5.0 | 5.0 | 4.3 | 5.0 | 4.7 |
| Sodium sulfite | 0.5 | 0.4 | 0.5 | 0.5 | 1.0 | 0.4 | 0.5 | 0.4 |
| Sodium polyacrylate | 5.0 | — | 4.0 | 5.0 | 5.0 | 4.3 | 5.0 | — |
| AA/MA | — | 4.2 | 1.1 | — | — | — | — | 4.7 |
| Fluorescent dye | 0.4 | 0.4 | 0.4 | 0.4 | 0.4 | 0.4 | 0.4 | 0.4 |
| Enzyme | 1.0 | 1.0 | 1.0 | 1.0 | 1.0 | 1.0 | 1.0 | 1.0 |
| Water | 5.6 | 5.1 | 5.5 | 5.6 | 3.0 | 2.7 | 7.6 | 4.0 |
| Perfume* | 0.5 | 0.5 | 0.5 | 0.5 | 0.5 | 0.5 | 0.5 | 0.5 |
| Total (part by weight) | 100.5 | 100.5 | 100.5 | 100.5 | 100.5 | 100.5 | 100.5 | 100.5 |
| Viscosity (mPa · s) | | | | | | | | |
| at 10 l/s | 16,450 | 24,756 | 35,000 | 16,450 | 1,192 | 4,060 | 62,265 | 79,003 |
| at 1000 l/s | 1,205 | 1,649 | 2,312 | 1,205 | 99 | 277 | 1,165 | 721 |
| Thickness (mm) | 1 | 1 | 0.5 | 8 | 1 | 1 | 1 | 1 |
| Conditions: | | | | | | | | |
| Temperature (° C.) | 80 | 80 | 80 | 120 | 130 | 80 | 80 | 80 |
| Shear rate (l/s) | 200 | 200 | 150 | 200 | 200 | 200 | 200 | 200 |
| Performance: | | | | | | | | |
| Shape retention | a | a | a | a | c | b | a | a |
| Coating properties (50–1000 l/s) | a | a | a | a | a | a | b | c |
| Solubility | a | a | a | b | a | a | c | c |

*The total amount of the components other than the perfume is taken as 100 wt %.

As is apparent from the results shown in Table 1, application under the conditions of Examples 1 to 3 resulted in formation of a satisfactory thin layer having a uniform thickness in both the longitudinal and the width directions with no defects such as air bubbles. The thin layer exhibited satisfactory solubility, scarcely leaving a residue of the detergent composition in the solubility evaluation.

The sheet type laundry detergent prepared under the conditions of Example 4 left a slight residue of the detergent composition in the solubility evaluation but was otherwise satisfactory.

The thin layer formed under the conditions of Comparative Example 1 failed to have sufficient shape retention and a uniform thickness in both the longitudinal and the width directions.

In any of Examples 1 to 4 and Comparative Example 1, where the shear rate in application was out of the range of 10 to 1000 $s^{-1}$, the doughy detergent composition generated coating defects such as streaks and missing coating, failing to provide a satisfactory thin layer.

As shown in Examples 1 to 4, it is essentially required for the doughy detergent composition to have a viscosity falling within a range of from 1,000 mPa·s to 50,000 mPa·s under a shear rate condition of 10 to 1,000 $s^{-1}$. Satisfactory results were not obtained with a doughy detergent composition of which the viscosity under a shear rate condition of 10 to 1,000 $s^{-1}$ is out of the range 1,000 mPa·s to 50,000 mPa·s, proving that such application is out of the scope of the present invention.

Examples 5 to 8 and Comparative Examples 5, 7 and 8

Application Method B

The doughy detergent compositions prepared in the respective Preparation Examples were used to produce sheet type laundry detergents in the same manner as in Example 1.

Performance Evaluation

The sheet type laundry detergents obtained in Examples 5 to 8 and Comparative Examples 5, 7 and 8 were evaluated in terms of shape retention and coating properties in the same manner as described above. They were also evaluated for solubility and resistance to oozing of liquid components in accordance with the following methods. The results obtained are shown in Table 2.

1) Method of Evaluating Solubility

A 10 cm-side square was cut out of the sheet type laundry detergent and put in a washing machine (Ginga 3.6 (VH360S1), manufactured by Toshiba Corp.) having 30 liters of tap water at 5° C. Immediately thereafter, water was agitated in a "strong agitation mode" and sampled at 3-minute and 15-minute agitation. The sample was rapidly filtered using a 10 ml-volume syringe having a disposable membrane filter unit 25AS020AN (pore size: 0.20 micron), available from Toyo Roshi Kaisha, Ltd., attached to the tip thereof. The tap water used for evaluation and the sample filtrates at 3-minute and 15-minute agitation were allowed to warm to room temperature, and their electrical conductivity was measured with a conductivity meter Model CM-60V, supplied by To a Electronics Ltd. The solubility was calculated from formula (6) shown below and graded based on the following criteria.

$$\text{Solubility (\%)}=[(\text{conductivity of sample filtrate at 3-minute agitation}-\text{conductivity of tap water})/(\text{conductivity of sample filtrate at 15-minute agitation}-\text{conductivity of tap water})]\times 100 \quad (6)$$

a: Solubility: 80% or more b: Solubility: 70% or more and less than 80% c: Solubility: less than 70%

2) Method of Evaluating Resistance to Oozing of Liquid Components

A stainless steel pipe having an inner diameter of 28 mm and a wall thickness of 3 mm was cut to a length of 40 mm, and the cut area was chamfered to prepare a cylindrical cell. The cell was filled with the composition as extruded from the application apparatus, placed upright, and struck against a rigid flat surface to level the bottom surface of the composition in the cell to prepare a test sample. The test sample was put on a stack of five sheets of filter paper No. 2 (75 mm by 90 mm), available from Toyo Roshi Kaisha, Ltd. with a 200 mesh metal net interposed between the sample and the paper stack, and allowed to stand at 50° C. for 48 hours. The weight increase (g) of the filter paper stack due to oozing from the composition was measured as an amount of oozing, from which resistance against oozing was evaluated based on the following criteria.

a: Amount of oozing: 0.5 g or less b: Amount of oozing: 0.5 to 1.0 g c: Amount of oozing: 1.0 g or more

TABLE 2

| | Example | | | | Comparative Example | | | |
|---|---|---|---|---|---|---|---|---|
| | 5 | 6 | 7 | 8 | 5 | 6 | 7 | 8 |
| Doughy Detergent Composition (wt %): | | | | | | | | |
| Nonionic surfactant (a) | 34.5 | 29.9 | — | 29.9 | 49.0 | — | 27.2 | — |
| Nonionic surfactant (b) | — | — | 28.0 | — | — | 41.5 | — | 27.8 |
| LAS-Na | 6.9 | 6.0 | 5.6 | 6.0 | 4.9 | 8.3 | 5.4 | 2.8 |
| AS-Na | 9.9 | 6.0 | 8.4 | 6.0 | 4.9 | 4.2 | 8.1 | 5.6 |
| PEG | — | 0.6 | 0.6 | 0.6 | — | — | 0.5 | 1.1 |
| Soda ash dense | 13.0 | 11.0 | 11.0 | 11.0 | 14.0 | 13.0 | 10.0 | 10.0 |
| Zeolite | 22.2 | 26.7 | 26.4 | 26.7 | 15.6 | 18.8 | 27.9 | 30.0 |
| Sodium carbonate | 6.0 | 7.2 | 7.0 | 7.2 | 4.2 | 5.0 | 7.6 | 7.9 |
| Sodium sulfate | 3.0 | 3.6 | 3.6 | 3.6 | 2.1 | 2.5 | 3.8 | 4.1 |
| Sodium sulfite | 0.3 | 0.4 | 0.3 | 0.4 | 0.2 | 0.2 | 0.4 | 0.4 |
| Sodium polyacrylate | 3.0 | 3.6 | — | 3.6 | 2.1 | — | 3.8 | — |
| AA/MA | — | — | 3.6 | — | — | 2.5 | — | 4.1 |
| Fluorescent dye | 0.2 | 0.3 | 0.3 | 0.3 | 0.2 | 0.2 | 0.3 | 0.4 |
| Enzyme | 0.6 | 0.7 | 0.9 | 0.7 | 0.4 | 0.6 | 0.8 | 1.0 |
| Water | 3.4 | 4.0 | 4.3 | 4.0 | 2.4 | 3.1 | 4.2 | 4.9 |
| Perfume* | 0.5 | 0.5 | 0.5 | 0.5 | 0.5 | 0.5 | 0.5 | 0.5 |
| Total (part by weight) | 100.5 | 100.5 | 100.5 | 100.5 | 100.5 | 100.5 | 100.5 | 100.5 |
| Viscosity (mPa · s) | | | | | | | | |
| at 10 l/s | 14,125 | 46,416 | 152,522 | 46,416 | 398 | 4,299 | 501,187 | 1,646,898 |

TABLE 2-continued

| | Example | | | | Comparative Example | | | |
|---|---|---|---|---|---|---|---|---|
| | 5 | 6 | 7 | 8 | 5 | 6 | 7 | 8 |
| at 1000 l/s | 1,308 | 3,594 | 9,873 | 3,594 | 63 | 476 | 27,123 | 74,511 |
| Casson's Coefficients | | | | | | | | |
| $C_0$ | 9.2 | 17.3 | 32.4 | 17.3 | 1.3 | 4.9 | 60.4 | 112.3 |
| $C_1$ | 0.9 | 1.3 | 2.1 | 1.3 | 0.2 | 0.5 | 3.3 | 5.1 |
| Thickness (mm) | 1 | 1 | 0.5 | 8 | 1 | 1 | 1 | 1 |
| Conditions: | | | | | | | | |
| Temperature (° C.) | 80 | 80 | 80 | 120 | 130 | 80 | 80 | 80 |
| Shear rate (l/s) | 200 | 200 | 150 | 200 | 200 | 200 | 200 | 200 |
| Performance: | | | | | | | | |
| Shape retention | a | a | a | a | c | b | a | a |
| Coating properties (50–1000 l/s) | a | a | a | a | a | a | b | c |
| Solubility | a | a | a | b | a | a | c | c |
| Resistance to oozing | a | a | a | a | c | c | a | a |

*The total amount of the components other than the perfume is taken as 100 wt %.

As is apparent from the results shown in Table 2, application under the conditions of Examples 5 to 7 formed a satisfactory thin layer having a uniform thickness in both the longitudinal and the width directions with no defects such as air bubbles. The thin layer exhibited satisfactory solubility scarcely leaving a residue of the detergent composition in the solubility evaluation.

The sheet type laundry detergent prepared under the conditions of Example 8 left a slight residue of the detergent composition in the solubility evaluation but was otherwise satisfactory.

Application under the conditions of Comparative Example 5 failed to secure sufficient shape retention and a uniform thickness in both the longitudinal and the width directions of the thin layer.

Application under the conditions of Comparative Examples 7 and 8 failed to provide a satisfactory thin layer. The thin layers had poor continuity and always suffered from defects such as large air bubbles. The resulting sheet type laundry detergents left a large amount of a residue of the detergent composition, showing poor solubility, in the solubility evaluation.

In any of Examples 5 to 8 and Comparative Examples 5, 7 and 8, where the shear rate in application was out of the range of 10 to 1000 $s^{-1}$, the doughy detergent composition generated coating defects such as streaks and missing coating, failing to provide a satisfactory thin layer.

Examples 9 to 11 and Comparative Examples 9 TO 11

Application Method C

The doughy detergent compositions prepared in the respective Preparation Examples were used to produce sheet type laundry detergents in the same manner as in Example 1. The thixotropic flow index TR of the doughy detergent compositions when applied was as shown in Table 3. The doughy detergent composition was applied to make a rectangular layer of 6.5 cm in width, 7 cm in length, and 2 mm in thickness.

Performance Evaluation

The sheet type laundry detergents obtained in Examples 9 to 11 and Comparative Examples 9 to 11 were evaluated for coating properties and solubility in the same manner as described above. They were also evaluated for detergency in accordance with the following method. The evaluation of solubility was carried out by the same procedure as in Example 5, and the resulting solubility values were graded according to the following criteria. The results obtained are shown in Table 3.

Criteria for Solubility Evaluation a: Solubility: 80% or more b: Solubility: 75% or more and less than 80% c: Solubility: 70% or more and less than 75% d: Solubility: less than 70%

Method of Evaluating Detergency (1) Preparation of Simulated Soiled Cloth

A simulated soil liquid having the following composition was printed on cloth by means of a gravure roll coater to prepare simulated soiled cloth. Gravure printing was carried out under conditions of cell capacity: 58 $cm^3/cm^2$; coating speed: 1.0 m/min; drying temperature: 100° C.; and drying time: 1 hour. Cotton shirting 2003, available from Yagashira Shoten, was used as cloth.

| Composition of simulated soil liquid | |
|---|---|
| Lauric acid | 0.44% |
| Myristic acid | 3.09% |
| Pentadecanoic acid | 2.31% |
| Palmitic acid | 6.18% |
| Heptadecanoic acid | 0.44% |
| Stearic acid | 1.57% |
| Oleic acid | 7.75% |
| Trioleic acid | 13.06% |
| n-Hexadecyl palmitate | 2.18% |
| Squalene | 6.53% |
| Liquid crystal of egg white lecithin | 1.94% |
| Kanuma soil | 8.11% |
| Carbon black | 0.01% |
| Tap water | balance |

(2) Washing Conditions and Method of Evaluation

Fives swatches (10 cm by 10 cm) of the simulated soiled cloth were put into 1 liter of an aqueous detergent solution for evaluation and washed in a tergotometer at 100 rpm under the following conditions.

| | |
|---|---|
| Washing time: | 10 minutes |
| Detergent concentration: | 0.0005 |
| Water hardness: | 4° DH |
| Water temperature: | 20° C. |
| Rinsing: | 5 minutes with tap water |

The reflectances of the clean swatch and the soiled swatch before and after washing were measured at 550 nm with an autographic calorimeter, supplied by Shimadzu Corp., to obtain detergency (%) according to formula (7) shown below. The detergency was evaluated from the average of measured detergency values of the five swatches according to the following criteria.

$$\text{Detergency (\%)}=[(\text{reflectance after washing}-\text{reflectance before washing})/(\text{reflectance of clean swatch}-\text{reflectance before washing})]\times 100 \quad (7)$$

a: 60% or more
b: 55% or more and less than 60%
c: 50% or more and less than 55%
d: Less than 50%

TABLE 3

| | Example | | | Comparative Example | | |
|---|---|---|---|---|---|---|
| | 9 | 10 | 11 | 9 | 10 | 11 |
| Doughy Detergent Composition (wt %): | | | | | | |
| Nonionic surfactant (a) | 42.4 | 33.8 | 28.0 | 33.8 | 26.3 | 34.8 |
| Na laurate | 3.4 | — | 1.4 | — | — | 1.7 |
| LAS-Na | — | — | 11.2 | — | — | — |
| AS-Na | — | 6.8 | — | 6.8 | 5.3 | — |
| PEG | — | 1.0 | — | 1.0 | 0.8 | — |
| Zeolite | 31.1 | 33.5 | 34.1 | 33.5 | 38.8 | 36.4 |
| Sodium carbonate | 8.4 | 9.1 | 9.2 | 9.1 | 10.5 | 9.8 |
| Sodium sulfate | 4.2 | 4.5 | 4.6 | 4.5 | 5.2 | 4.9 |
| Sodium sulfite | 0.4 | 0.5 | 0.5 | 0.5 | 0.5 | 0.5 |
| Sodium polyacrylate | 4.2 | 4.5 | 4.6 | 4.5 | 5.2 | 4.9 |
| Fluorescent dye | 0.3 | 0.4 | 0.4 | 0.4 | 0.4 | 0.4 |
| Enzyme | 0.8 | 0.9 | 0.9 | 0.9 | 1.0 | 1.0 |
| Water | 4.7 | 5.1 | 5.2 | 5.1 | 5.9 | 5.5 |
| Perfume* | 0.5 | 0.5 | 0.5 | 0.5 | 0.5 | 0.5 |
| Total (part by weight) | 100.5 | 100.5 | 100.5 | 100.5 | 100.5 | 100.5 |
| Viscosity (mPa · s) at 10 l/s | 16,000 | 10,000 | 19,000 | 120,000 | 14,500 | 16,500 |
| Conditions: | | | | | | |
| Time till application (hr) | 1 | 1 | 1 | 1 | 1 | 1 |
| Thixotropic flow index TR | 25 | 10 | 50 | 250 | 65 | 135 |
| Shear rate (l/s) | 200 | 200 | 200 | 200 | 200 | 200 |
| Temperature (° C.) | 80 | 80 | 80 | 45 | 80 | 80 |
| Performance: | | | | | | |
| Coating properties (10–1000 l/s) | a | a | a | c | b | c |
| Solubility | a | a | b | d | c | d |
| Detergency | b | a | a | b | a | a |

*The total amount of the components other than the perfume is taken as 100 wt %.

Examples 12 and 13 and Comparative Example 12

A sheet type laundry detergent was prepared in the same manner as in Example 9, except that the doughy detergent composition used in Example 9 was applied after the elapse of time shown in Table 4 under the shear rate and temperature conditions shown in the Table. The thixotropic flow index TR of the doughy detergent composition at the time of application was as shown in Table 4. The resulting sheet type laundry detergents were evaluated for coating properties in the same manner as in Example 9. The results obtained are shown in Table 4.

TABLE 4

| | Example | | Comparative |
|---|---|---|---|
| | 12 | 13 | Example 12 |
| Viscosity (mPa · s) at 10 l/s | 17,000 | 17,500 | 18,000 |
| Conditions: | | | |
| Time till application (hr) | 3 | 6 | 24 |
| Thixotropic flow index TR | 40 | 60 | 150 |
| Shear rate (l/s) | 200 | 200 | 200 |
| Temperature (° C.) | 80 | 80 | 80 |
| Coating properties (10–1000 l/s) | a | b | c |

Examples 14 and 15 and Comparative Example 13

A sheet type laundry detergent was prepared in the same manner as in Example 10, except that the doughy detergent composition used in Example 10 was applied after the elapse of time shown in Table 5 under the shear rate and temperature conditions shown. The thixotropic flow index TR of the doughy detergent composition at the time of application was as shown in Table 5. The resulting sheet type laundry detergents were evaluated for coating properties in the same manner as in Example 9. The results obtained are shown in Table 5.

TABLE 5

| | Example | | Comparative |
|---|---|---|---|
| | 14 | 15 | Example 13 |
| Viscosity (mPa · s) at 10 l/s | 10,000 | 12,500 | 14,000 |
| Conditions: | | | |
| Time till application (hr) | 3 | 6 | 24 |

TABLE 5-continued

| | Example | | Comparative |
|---|---|---|---|
| | 14 | 15 | Example 13 |
| Thixotropic flow index TR | 25 | 50 | 85 |
| Shear rate (l/s) | 200 | 200 | 200 |
| Temperature (° C.) | 80 | 80 | 80 |
| Coating properties (10–1000 l/s) | a | a | b |

Examples 16 and 17 and Comparative Example 14

A sheet type laundry detergent was prepared in the same manner as in Example 11, except that the doughy detergent composition used in Example 11 was applied after the elapse of time shown in Table 6 under the shear rate and temperature conditions shown. The thixotropic flow index TR of the doughy detergent composition at the time of application was as shown in Table 6. The resulting sheet type laundry detergents were evaluated for coating properties in the same manner as in Example 9. The results obtained are shown in Table 6.

TABLE 6

| | Example | | Comparative |
|---|---|---|---|
| | 16 | 17 | Example 14 |
| Viscosity (mPa · s) at 10 l/s | 18,000 | 20,000 | 22,500 |
| Conditions: | | | |
| Time till application (hr) | 3 | 6 | 24 |
| Thixotropic flow index TR | 50 | 55 | 60 |
| Shear rate (l/s) | 200 | 200 | 200 |
| Temperature (° C.) | 80 | 80 | 80 |
| Coating properties (10–1000 l/s) | a | b | b |

As is apparent from the results shown in Tables 3 through 6, where a doughy detergent composition is applied under the conditions of each Example, there is obtained a satisfactory thin layer having a uniform thickness in both the longitudinal and the width directions with few defects such as air bubbles. The thin layer leaves virtually no residue in the evaluation of solubility, proving satisfactorily soluble. It is also seen that the thin layer exhibits sufficiently high detergency.

Examples 18 to 20 and Comparative Examples 15 TO 17

Application Method D

A sheet type laundry detergent was prepared by using the doughy detergent composition obtained in the respective Preparation Example in the same manner as in Example 1. The plastic flow index BF and the thixotropic flow index TR of the doughy detergent composition at the time of application were as shown in Table 7. The doughy detergent composition was applied to make a rectangular layer of 6.5 cm in width, 7 cm in length, and 2 mm in thickness.

Performance Evaluation

The sheet type laundry detergents obtained in Examples 18 to 20 and Comparative Examples 15 to 17 were evaluated for coating properties, solubility, and detergency in the same manner as in Example 9. The results obtained are shown in Table 7.

TABLE 7

| | Example | | | Comparative Example | | |
|---|---|---|---|---|---|---|
| | 18 | 19 | 20 | 15 | 16 | 17 |
| Doughy Detergent Composition (wt %): | | | | | | |
| Nonionic surfactant (a) | 38.1 | 30.1 | 24.8 | 30.0 | 28.2 | 32.6 |
| Na laurate | 3.1 | — | 1.2 | — | — | 1.6 |
| LAS-Na | — | — | 9.9 | — | — | — |
| AS-Na | — | 6.0 | — | 6.0 | 5.6 | — |
| PEG | — | 0.9 | — | 0.9 | 0.8 | — |
| Zeolite | 33.7 | 36.1 | 36.7 | 36.1 | 37.5 | 37.7 |
| Sodium carbonate | 9.1 | 9.8 | 9.9 | 9.8 | 10.1 | 10.2 |
| Sodium sulfate | 4.6 | 4.9 | 5.0 | 4.9 | 5.1 | 5.1 |
| Sodium sulfite | 0.5 | 0.5 | 0.5 | 0.5 | 0.5 | 0.5 |
| Sodium polyacrylate | 4.6 | 4.9 | 5.0 | 4.9 | 5.1 | 5.1 |
| Fluorescent dye | 0.4 | 0.4 | 0.4 | 0.4 | 0.4 | 0.4 |
| Enzyme | 0.9 | 1.0 | 1.0 | 1.0 | 1.0 | 1.0 |
| Water | 5.1 | 5.5 | 5.6 | 5.5 | 5.7 | 5.7 |
| Perfume* | 0.5 | 0.5 | 0.5 | 0.5 | 0.5 | 0.5 |
| Total (part by weight) | 100.5 | 100.5 | 100.5 | 100.5 | 100.5 | 100.5 |
| Viscosity (mPa · s) at 10 l/s | 18,000 | 11,500 | 15,000 | 200,000 | 15,000 | 13,000 |
| Conditions: | | | | | | |
| Time till application (hr) | 1 | 1 | 1 | 1 | 1 | 1 |
| Plastic flow index BF | 2.7 | 5.5 | 3.0 | 15.5 | 10.5 | 12.5 |
| $D\eta_1$ | 0.85 | 0.84 | 0.87 | 0.83 | 0.87 | 0.86 |
| $D\eta_2$ | 0.87 | 0.89 | 0.90 | 0.96 | 0.96 | 0.97 |
| Thixotropic flow index TR | 35 | 20 | 45 | 200 | 70 | 150 |
| Shear rate (l/s) | 200 | 200 | 200 | 200 | 200 | 200 |
| Temperature (° C.) | 80 | 80 | 80 | 45 | 80 | 80 |

TABLE 7-continued

| | Example | | | Comparative Example | | |
|---|---|---|---|---|---|---|
| | 18 | 19 | 20 | 15 | 16 | 17 |
| Performance: | | | | | | |
| Coating properties (10–1000 l/s) | a | a | a | c | b | c |
| Solubility | a | b | b | d | c | d |
| Detergency | b | a | a | a | b | b |

*The total amount of the components other than the perfume is taken as 100 wt %.

As is apparent from the results shown in Table 7, where a doughy detergent composition is applied under the conditions of each Example, there is obtained a satisfactory thin layer having a uniform thickness in both the longitudinal and the width directions with few defects such as air bubbles. The thin layer leaves virtually no residue in the evaluation of solubility, proving satisfactorily soluble. It is also seen that the thin layer exhibits sufficiently high detergency.

TABLE 8

| | |
|---|---|
| Nonionic surfactant (a) | $C_{12}$–$C_{14}$ alcohol/EO (3.3) adduct (trade name: Softal 33 from Nippon Shokubai Co., Ltd.) having PO (2) and EO (4) added thereto |
| Nonionic surfactant (b) | $C_{12}$–$C_{14}$ alcohol (trade name: KALCOL 2475 from Kao Corp.) having EO (8) added thereto |
| Na laurate | Sodium laurate (trade name: LUNAC L-98, from Kao Corp.) |
| LAS-Na | Alkylbenzenesulfonic acid ($C_{10}$–$C_{14}$ alkyl chain) (trade name: Alken L from Nisseki Senzai K.K.) having been neutralized with 48% aq. NaOH |
| AS-Na | Sodium $C_{12}$–$C_{14}$ alkylsulfuric ester salt powder (trade name: EMAL 10P from Kao Corp.) |
| PEG | Polyethylene glycol (average molecular weight: about 8500) (trade name: K-PEG6000 from Kao Corp.) |
| Zeolite | A4 type crystalline sodium aluminosilicate powder (trade name: Toyobuilder from Tosoh Corp.) |
| Soda ash dense | Product available from Central Glass Co., Ltd. |
| Sodium polyacrylate | Average molecular weight: about 20000 |
| AA/MA | Acrylic acid/maleic acid copolymer (trade name: Socalan CP-5 from BASF) |
| Fluorescent dye | A 1:1 (by weight) mixture of Whitex SA from Sumitomo Chemical Co., Ltd. and Tinopal CBS-X from Ciba-Geigy |
| Enzyme | A 1:1:1:1 (by weight) mixture of Savinase 18.0T Type White, Lipolase 100T, Celluzyme 0.1T, and Termamyl 60T, all available from Novo Nordisk |

INDUSTRIAL APPLICABILITY

The methods of producing sheet type laundry detergent according to the present invention enable formation of a thin layer of a detergent composition with uniform thickness and width while retaining solubility and detergency on use.

According to the methods of the present invention for producing sheet type laundry detergent, a thin layer of a detergent composition can be formed without developing defects such as air bubbles.

The invention claimed is:

1. A method of producing a sheet laundry detergent which comprises continuously or discontinuously applying a doughy detergent composition on a flexible support of continuous length that is running continuously in a direction under a shear rate condition of 10 $s^{-1}$ to 1,000 $s^{-1}$ by an application means that is an extrusion die coater, to form a thin layer of said doughy detergent composition, wherein said flexible support is soluble or dispersible in water, wherein the doughy detergent composition has a viscosity of 16,450 to 35,000 mPa·s at a shear rate of 10 $s^{-1}$ and a viscosity of 1,205 to 2,312 mPa·s at a shear rate of 1,000 $s^{-1}$.

2. The method of producing a sheet laundry detergent according to claim 1, wherein the temperature of said doughy detergent composition at the time of said application means is 100° C. or lower.

3. The method of producing a sheet laundry detergent according to claim 1, wherein said thin layer has a thickness of 0.5 mm to 10 mm.

4. The method of producing a sheet laundry detergent according to claim 1, which further comprises superposing a flexible support on said thin layer so that said thin layer is covered on both sides thereof.

5. A method of producing a sheet laundry detergent which comprises continuously or discontinuously applying a doughy detergent composition on a flexible support of continuous length that is running continuously in a direction under a shear rate condition of 10 $s^{-1}$ to 1,000 $s^{-1}$ by an application means, wherein said flexible support is soluble or dispersible in water, wherein the doughy detergent composition has a viscosity of 16,450 to 35,000 mPa·s at a shear rate of 10 $s^{-1}$ and a viscosity of 1,205 to 2,312 mPa·s at a shear rate of 1,000 $s^{-1}$.

6. The method of producing a sheet laundry detergent according to claim 5, wherein said doughy detergent composition has been prepared so as to have coefficients $C_0$ and $C_1$ of the Casson's equation within ranges of $5<C_0<50$ and $0.5<C_1<3$, the Casson's equation being represented by formula (3):

$$\sqrt{\tau}=C_0+C_1\sqrt{\dot{\gamma}} \quad (3)$$

wherein $\tau$ represents a shear stress and $\dot{\gamma}$ represents a shear rate.

7. The method of producing a sheet laundry detergent according to claim 5, wherein said application means is an extrusion die coater.

8. The method of producing a sheet laundry detergent according to claim 5, wherein the temperature of said doughy detergent composition at the time of said application means is 100° C. or lower.

9. The method of producing a sheet laundry detergent according to claim 5, wherein said thin layer has a thickness of 0.5 mm to 10 mm.

10. The method of producing a sheet laundry detergent according to claim 5, which further comprises superposing a flexible support on said thin layer so that said thin layer is covered on both sides thereof.

11. A method of producing a sheet laundry detergent which comprises forming a doughy detergent composition having a viscosity of 16,450 to 35,000 mPa·s at a shear rate of 10 $s^{-1}$ and a viscosity of 1,205 to 2,312 mPa·s at a shear rate of 1,000 $s^{-1}$, and wherein said doughy detergent composition comprising at least one each of surface active agents, alkalis, and sequestering agents is formed into a thin layer while said doughy detergent composition has a thixotropic flow index TR of 60 or smaller, wherein said doughy detergent composition is applied continuously or discontinuously on a water-soluble or water-dispersible flexible support of continuous length which is continuously running in a direction by an application means to form said thin layer, said thixotropic flow index TR being represented by formula (1):

$$TR=(\Delta\eta(1)+\Delta\eta(10))\times 100 \quad (1)$$

wherein $\Delta\eta(1)=\eta(1)_{UP}-\eta(1)_{DOWN}$ $\Delta\eta(10)=\eta(10)_{UP}-\eta(10)_{DOWN}$ wherein $\eta(1)$ is a viscosity measured at at shear rate of 1 $s^{-1}$;

$\eta(10)$ is a viscosity measured at at shear rate of 10 $s^{-1}$;

subscript UP indicates "measured during loading"; and subscript DOWN indicates "measured during unloading".

12. The method of producing a sheet laundry detergent according to claim 11, wherein said doughy detergent composition is formed into said thin layer under a shear rate condition of 10 $s^{-1}$ to 1,000 $s^{-1}$.

13. The method of producing a sheet laundry detergent according to claim 11, wherein said thin layer has a perimeter to thickness ratio, a, in a range of $10<a<600$.

14. The method of producing a sheet laundry detergent according to claim 11, wherein said thin layer has a thickness of 0.5 mm to 10 mm.

15. The method of producing a sheet laundry detergent according to claim 11, wherein said doughy detergent composition is formed into said thin layer at 100° C. or lower.

16. The method of producing a sheet laundry detergent according to claim 11, which further comprises superposing a flexible support on said thin layer so that said thin layer is covered on both sides thereof.

17. A method of producing a sheet laundry detergent which comprises forming a doughy detergent composition having a viscosity of 16,450 to 35,000 mPa·s at a shear rate of 10 $s^{-1}$ and a viscosity of 1,205 to 2,312 mPa·s at a shear rate of 1,000 $s^{-1}$, and wherein said doughy detergent composition comprising at least one each of surface active agents, alkalis, and sequestering agents is formed into a thin layer while said doughy detergent composition has a plastic flow index BF of 6 or smaller, wherein said doughy detergent composition is applied continuously or discontinuously on a water-soluble or water-dispersible flexible support of continuous length which is running continuously in a direction by an application means to form said thin layer, said plastic flow index BF being represented by formula (2):

$$BF=\sqrt{\left(\frac{D\eta_2-D\eta_1}{D\eta_1}\right)^2}\times 100 \text{ wherein} \quad (2)$$

$$D\eta_1=\log\frac{\eta(10)}{\eta(1)}$$

$$D\eta_2=\log\frac{\eta(100)}{\eta(10)}$$

wherein $\eta(1)$ is a viscosity measured at a shear rate of 1 $s^{-1}$;

$\eta(10)$ is a viscosity measured at a shear rate of 10 $s^{-1}$; and $\eta(100)$ is a viscosity measured at a shear rate of 100 $s^{-1}$.

18. The method of producing a sheet laundry detergent according to claim 17, wherein said doughy detergent composition is formed into said thin layer while in the state that the value of said $D\eta_2$ is 0.95 or smaller.

19. The method of producing a sheet laundry detergent according to claim 17, wherein said doughy detergent composition is formed into said thin layer while in the state that the value of said $D\eta_2$ is 0.95 or smaller.

20. The method of producing a sheet laundry detergent according to claim 17, wherein said doughy detergent composition is formed into said thin layer while it has a thixotropic flow index TR represented by formula (1) of 60 or smaller.

21. The method of producing a sheet laundry detergent according to claim 17, wherein said doughy detergent composition is formed into said thin layer under a shear rate condition of 10 $s^{-1}$ to 1,000 $s^{-1}$.

22. The method of producing a sheet laundry detergent according to claim 17, wherein said thin layer has a thickness of 0.5 mm to 10 mm.

23. The method of producing a sheet laundry detergent according to claim 17, wherein said doughy detergent composition is formed into said thin layer at 100° C. or lower.

24. The method of producing a sheet laundry detergent according to claim 17, which further comprises superposing a flexible support on said thin layer so that said thin layer is covered on both sides thereof.

* * * * *